United States Patent [19]

Crowley

[11] Patent Number: 4,653,550

[45] Date of Patent: Mar. 31, 1987

[54] PORTABLE REFILLABLE INFLATOR

[76] Inventor: Joseph R. Crowley, 3430 Kindred Ave., 39 Moana Apts., Reno, Nev. 89502

[21] Appl. No.: 747,709

[22] Filed: Jun. 24, 1985

[51] Int. Cl.[4] ..... B65B 3/04

[52] U.S. Cl. ..... 141/18; 137/223; 222/505

[58] Field of Search ..... 141/1-12, 141/18-29, 37-66; 222/130, 505; 137/223, 227

[56] References Cited

U.S. PATENT DOCUMENTS 3,934,622 1/1976 Vitack et al. ..... 141/18

*Primary Examiner*—Houston S. Bell, Jr.

*Attorney, Agent, or Firm*—Hauke and Patalidis

[57] ABSTRACT

The portable refillable inflator for air mattresses, inflatable balls, pneumatic tires and the like, in the form of a tubular vessel provided at each end with an inverted domed wall. One wall is provided with a conventional tire inflation valve for filling the vessel with compressed air, and the other domed wall is provided, with an outlet valved nozzle having a flexible tubular body through which extends a stem attached to a disk disposed within the vessel and normally fitting against an annular seat. Upon deflection of the flexible nozzle body, lateral displacement of the stem causes the valve disk to uncover a portion of the seat thus permitting air to escape from the vessel through the outlet nozzle.

16 Claims, 4 Drawing Figures

PORTABLE REFILLABLE INFLATOR

BACKGROUND OF THE INVENTION

The present invention relates to a portable refillable inflator, in general, and more particularly to a portable refillable inflator for air mattresses, inflatable boats, balls, and the like, also useful as a motor vehicle emergency tire inflator.

Air mattresses and small air-inflatable boats are generally provided with a flap inlet valve allowing mouth inflation or, alternatively, with a combination inlet valve fitting enabling inflation from a supply of compressed air or by mouth. Other air inflated articles, such as beach balls, footballs, soccer balls, volleyballs, basketballs and the like, are generally inflatable from a source of compressed air through an appropriate adapter needle.

Mouth inflation of inflatable articles causes considerable lung and heart strain on the person inflating the article, and, a source of compressed air is generally not available to the common user for inflating compressed air-inflatable articles and mouth-inflatable articles.

SUMMARY OF THE INVENTION

The present invention provides a portable refillable supply of air held under pressure in a relatively small size container or vessel, which can be hand-carried, and which is refillable where compressed air is available as, for example, at fuel-filling stations.

The many advantages and objects of the present invention will become aparent to those skilled in the art when the following description of an example of the best mode contemplated for practicing the invention is read in conjunction with the accompanying drawing wherein:

DETAILED DESCRIPTION OF THE PREFERRED EMBODIMENT

Figure 1:
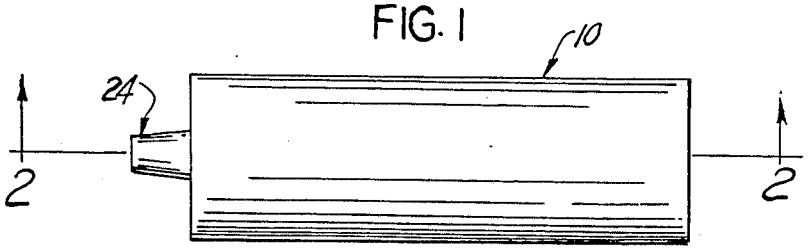
FIG. 1 is an elevation view of a portable refillable air inflator according to the present invention.
Figure 2:
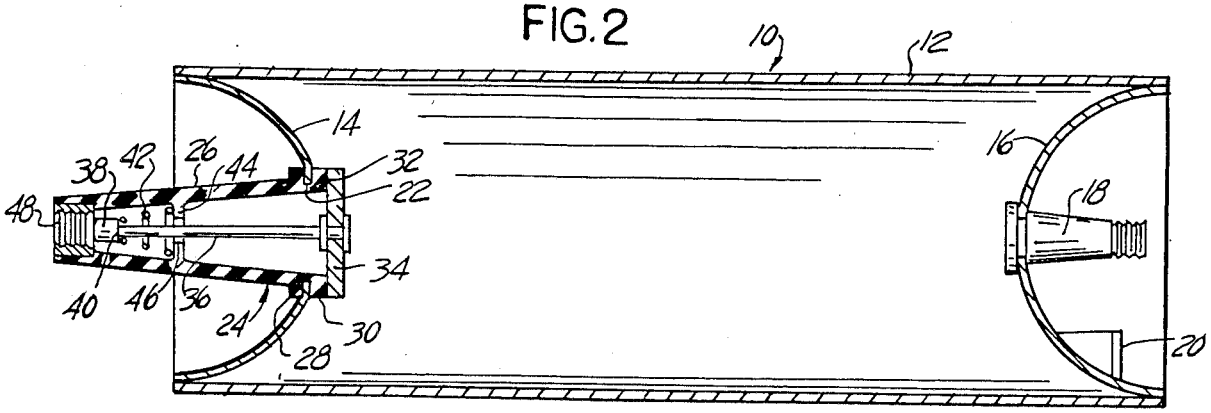
FIG. 2 is a partial longitudinal section along lines 2—2 of FIG. 1.

Referring to the drawing, the portable refillable inflator of the invention takes the form of a cylindrical pressure vessel 10 comprising a tubular member 12 provided at each end with a domed wall, substantially hemispherical, as shown at 14 and 16 at FIG. 2. Each domed end wall 14 or 16 is welded, brazed, or otherwise fastened inverted at the end rim of the tubular member 12 such that its top projects inwardly within the tubular member 12. One domed end wall, for example the end wall 16, is provided with a centrally disposed opening in which is affixed a conventional pneumatic tire inflating valve 18, and may be provided with an air gauge 20 to indicate the air pressure within the vessel 10.

The other inverted domed end wall 14 has a centrally disposed opening 22 in which is fitted a flexible inflating nozzle 24 having a tapered tubular body 26 made of flexible and resilient material such as rubber, neoprene, or the like. The base of the tapered tubular body 26 is provided with a pair of integral outwardly extending outer and inner flanges 28 and 30 respectively, for forming a leakproof fitting within the opening 22 in the domed end wall 14. The inner flange 30 defines an annular seat 32 for a valve disk 34 fixedly mounted on one end of a rigid rod or stem 36 extending part of the way through the center of the flexible tapered tubular body 26. The other end of the stem 36 has an enlarged portion 38 forming an annular shoulder 40 engaged by an end of a compressed relatively weak coil spring 42 having its other end engaged with a shoulder abutment 44 radially extending from the interior surface of the tapered tubular body 26. The rod or stem 36 passes, with clearance, through a central aperture 46 through the integral abutment or shoulder 44. The projecting end of the valve tubular body 26 is internally provided with a bonded-on internally-threaded sleeve 48 for fitting the externally-threaded end of a conventional bicycle or motor vehicle tire valve and for fitting a needle adapter.

Figure 3:
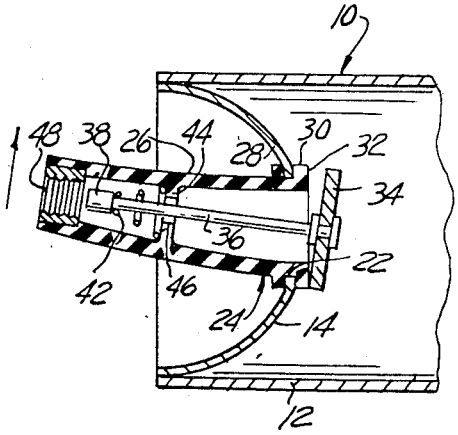
FIGS. 3 and 4 are partial views similar to FIG. 2 but showing the inflator in use.

In operation, the vessel 12 is filled with compressed air, for example at 50 psi, through the conventional tire valve 18. In the position of the valve disk 34 illustrated at FIG. 2, the valve disk 34 is applied against the valve seat 32 by the pressure of the air contained within the vessel 10 and by the pull exerted by the weak coil spring 42 upon the rod or stem 36, and air is prevented from escaping through the inflating nozzle 24. When it is desired to inflate an inflatable article, such as an air mattress for example, the end of the valve flexible tubular body 26 is introduced through the valve opening in the article and the flexible body 26 of the nozzle 24 is manually flexed, as illustrated at FIG. 3. Flexing the flexible body 26 of the nozzle 24 causes the valve rod or stem 26 to be displaced laterally, as shown at FIG. 3, at an angle relative to the vessel longitudinal axis, with the result that the valve disk 34 is tilted at an angle relative to the annular seat 32 thus opening the interior of the vessel 12 to the interior of the inflatable article, via the flexed nozzle body 26, the air escaping through the space between the face of the valve disk 34 and the seat surface 32 into the tubular nozzle body 26 and through the aperture 46. When the flexible body 26 of the nozzle 24 is allowed to recover its original shape, the valve disk 34 is again applied against the valve seat 32, thus interrupting the flow of air through the nozzle tubular body 26.

The invention can also be used as an emergency motor vehicle tire inflator, by screwing the threaded insert 48 at the end of the nozzle tubular body onto the end of a tire valve, and by manually deflecting or bending the nozzle body 26 as illustrated at FIG. 3.

Figure 4:
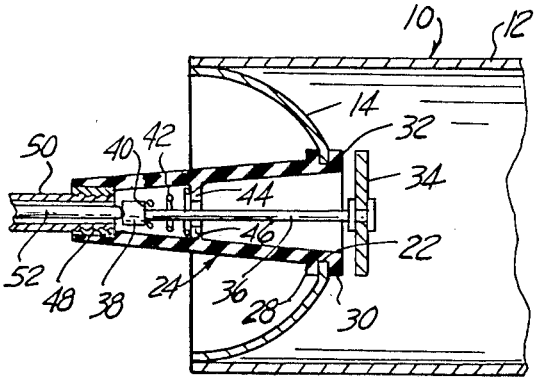

FIG. 4 illustrates the portable refillable air inflator in use, for example, for inflating a bicycle, motorcycle, or motor vehicle tire provided with a conventional tire valve 50, or any other valve having a centrally disposed stem 52 capable of abutting against the enlarged head 38 of the valve stem 36 such as to displace the valve disk 34 away from the seat 32 and such as to allow air contained in the vessel 10 to escape through the nozzle body 26 into the fitting or body of the tire valve 50.

The structure described and illustrated, providing for the domed end walls 14 and 16 being affixed inverted at the ends of the vessel 10, results in the body of the inlet valve 18 and the majority of the nozzle 24 being disposed each in a recess and being protected against accidental damage or accidental escape of air from the vessel 10 during transportation and manual carrying.

Having thus described the present invention by way of an example of structure given for illustrative purpose only, modifications whereof will be apparent to those skilled in the art, what is claimed as new is as follows:

1. A portable refillable air inflator comprising a tubular vessel having end walls, a conventional pneumatic tire inflation valve mounted in one of said end walls for filling said vessel with pressurized air, and a manually operable outlet valve disposed through an aperture in said other end wall, said outlet valve having a flexible tubular body provided with an annular seat at an end disposed in said vessel, a disk engageable with said annular seat, a substantially rigid stem projecting from said disk longitudinally in the interior of said valve flexible tubular body, whereby when said valve flexible tubular body is manually flexed laterally, said stem is displaced at an angle to the longitudinal axis of said vessel thus tilting said valve disk away from said seat.

2. The inflator of claim 1 further comprising an enlarged head portion at the end of said stem, a coil spring disposed around said stem below said enlarged head portion and an annular abutment in said valve body for engagement with an end of said spring.

3. The inflator of claim 1 further comprising an internal thread formed at the free end of said valve body, said internal thread being adapted to mate with a conventional tire valve.

4. The inflator of claim 2 further comprising an internal thread formed at the free end of said valve body, said internal thread being adapted to mate with a conventional tire valve.

5. The inflator of claim 1 wherein said end walls are domed shaped and have a top disposed inwardly of said tubular member.

6. The inflator of claim 2 wherein said end walls are domed shaped and have a top disposed inwardly of said tubular member.

7. The inflator of claim 3 wherein said end walls are domed shaped and have a top disposed inwardly of said tubular member.

8. The inflator of claim 4 wherein said end walls are domed shaped and have a top disposed inwardly of said tubular member.

9. The inflator of claim 1 further comprising a gauge indicating the air pressure in said vessel.

10. The inflator of claim 2 comprising a gauge indicating the air pressure in said vessel.

11. The inflator of claim 3 comprising a gauge indicating the air pressure in said vessel.

12. The inflator of claim 4 comprising a gauge indicating the air pressure in said vessel.

13. The inflator of claim 5 comprising a gauge indicating the air pressure in said vessel.

14. The inflator of claim 6 comprising a gauge indicating the air pressure in said vessel.

15. The inflator of claim 7 comprising a gauge indicating the air pressure in said vessel.

16. The inflator of claim 8 comprising a gauge indicating the air pressure in said vessel.

* * * * *